US005425211A

United States Patent [19]

Lorenz

[11] Patent Number: 5,425,211

[45] Date of Patent: Jun. 20, 1995

[54] WALL COMPONENT AND WALL FORMED THEREFROM

[76] Inventor: Hans-Peter Lorenz, Gieselbachstr. 21, D-77866 Rheinau-Honau, Germany

[21] Appl. No.: 136,009

[22] Filed: Oct. 14, 1993

[30] Foreign Application Priority Data

Oct. 23, 1992 [DE] Germany ..... 9214307 U

[51] Int. Cl.[6] ..... E04B 1/02

[52] U.S. Cl. ..... 52/561; 52/568

[58] Field of Search ..... 52/699, 561, 405, 233, 52/568

[56] References Cited

U.S. PATENT DOCUMENTS

| | | | |
|---|---|---|---|
| 994,027 | 5/1911 | O'Beirne | 52/561 |
| 3,728,834 | 4/1973 | Dean | 52/568 X |
| 3,999,349 | 12/1976 | Miele et al. | 52/568 |
| 4,517,780 | 5/1985 | Lacombe et al. | 52/233 |
| 4,976,079 | 12/1990 | Liljgren | 52/561 X |
| 5,163,259 | 11/1992 | Hunsaker et al. | 52/233 |

FOREIGN PATENT DOCUMENTS

| | | | |
|---|---|---|---|
| 123390 | 10/1885 | United Kingdom | 52/561 |

*Primary Examiner*—Carl D. Friedman
*Assistant Examiner*—Creighton Smith
*Attorney, Agent, or Firm*—Antonelli, Terry, Stout & Kraus

[57] ABSTRACT

The invention relates to a wall component for forming a building wall. In order to provide an easily handlable wall component and a wall formed from a plurality of such wall components, which can be rapidly erected and makes it possible to have a desired wall course, the wall component is formed by two vertical, parallel wall panels made from wood or a wooden material, which are kept spaced by web plates. The wall panels are provided on their top, bottom and end faces with connecting elements for engaging with corresponding connecting elements of adjacent wall components. Preferably the connecting elements are formed by grooves and tongues.

19 Claims, 6 Drawing Sheets

WALL COMPONENT AND WALL FORMED THEREFROM

TECHNICAL FIELD

The invention relates to a wall component for forming a building wall, as well as a wall formed from a plurality of such wall components.

BACKGROUND ART

Wood or wooden material building walls are normally erected at the installation point by installing a support structure, followed by the covering of the latter with wooden or fiber boards. Optionally the hollow wall formed in this way is filled with an insulating material. The installation of such a wall is relatively complicated and therefore cost-intensive due to the large number of work activities to be performed at the building site. In addition, the construction is non-linear, i.e. there are highly labor-intensive, angular wall courses.

It is known to prefabricate wooden building walls in the factory and to bring them to the building site as a finished component and install then there. Although this leads to an economic production of the wall, the construction of an -individual wall design involves a considerable conversion of machines and tools, so that prefabricated walls are only available in a small number of different designs. In addition, there is then the transportation and assembly of such a prefabricated wall requiring the use of cranes and tools, so that the wall can only be erected by correspondingly equipped firms, but not by individuals, particularly on a do-it-yourself basis.

DISCLOSURE OF THE INVENTION

The object of the invention is to provide an easily handlable wall component and a wall formed from a plurality of such components, which can be rapidly erected and permits a desired wall course.

According to the invention this problem is solved by a wall component, which is characterized by two vertical, parallel wood or wooden material wall panels, which are kept spaced by web plates, the wall panels having on their top surface, bottom surface and end faces connecting elements for engagement with corresponding connecting elements of neighboring wall components.

The box-type wall components formed in this way can be combined to form a wall by superimposing in the form of several layers. The connecting elements on the wall panels ensure the engagement of both the wall components juxtaposed in one layer, as well as the superimposed wall components, so that it is possible to ensure a reliable reciprocal positioning of the wall components and an adequate overall stability of the wall.

The web plates which maintain the reciprocal spacing of the wall panels, are substantially perpendicular to the latter, which leads to the formation of a stable box with a substantially rectangular cross-section. The web plates should also be made from wood or a wooden material, so that the wall component is built up from a unitary material. Preferably the wall panels and web plates are glued or bonded and/or clamped and/or screwed and/or nailed and/or keyed together.

The groove and tongue have proved satisfactory as connecting elements and as a result there is no need to construct and fit special fittings. According to a preferred development of the invention on the top of each wall panel is provided a tongue, whilst on the bottom a corresponding groove is provided. Corresponding groove and tongue designs are also provided on the end faces of the wall panels.

According to an advantageous development of the invention the outside of the web plates terminates flush with the end faces of the wall panels. As a result the outsides of the web plates of juxtaposed wall components come into contact, so that there is a full-surface engagement of the wall components. By gluing and/or screwing the abutting web plates of adjacent wall components, it is possible to ensure a reliable reciprocal positioning of the wall components and a high wall stability. However, it is also possible to space the web plates from the end faces of the wall panels, which in particular avoids excessive cold bridges.

Preferably the top of the web plates terminates flush with the tops of the wall panels. However, the bottom of the web plates runs at a certain distance above the bottoms of the wall panels. Thus, between the top of the web plates of one wall component and the bottom of the web plates of a wall component positioned above it, there is a passage channel or duct running in the wall longitudinal direction and which can be used for receiving installation lines and pipes.

The interior of the wall component bounded by the wall panels and web plates is preferably filled with insulating material, which can be in the form of glass wool, cellulose, wood shavings, cork scraps, straw, pugging mortar and similar materials.

In order to give the wall a specific appearance as desired by the owner, the outside of the wall panel can be provided with a facing. The facing can be kept by means of a support structure, e.g. a lath arrangement, spaced from the outer wall panel, which leads to a back-ventilated facade. The facing can be formed by a profile boarding, plaster or a clinker facing. A profile boarding leads to the advantage that the profile boarding layer of a wall component with the lower profile boarding layer of a wall component located above it can be engaged by means of a tongue and groove connection, so that the facing of adjacent wall components is reciprocally fixed and supported.

Preferably the wall panels are substantially planar, so that the wall component has a parallelepipedic configuration. For forming a wall corner or angle it is possible to provide a wall component, whose wall panels are angular. The wall panels comprise two interconnected panel elements, which are engageable and disengageable by means of detachable fittings. It is possible for the panel elements to be at a specific angle to one another, so that such a wall component can be used as a corner stone. For forming a building corner or quoin the panel elements are preferably at a right angle to one another.

A wall component assemblable by detachable fittings also leads to the further advantage that it can be passed around a given vertical support of a building support structure without having to damage the wall component.

With regards to the wall, the set problem is solved according to the invention in that the wall components are superimposed and juxtaposed in several layers and interconnected. The wall components are preferably glued or bonded and/or clamped and/or screwed and/or nailed and/or keyed together. Adjacent wall components of a layer are, additionally to the connecting elements of the wall panels, interconnected by means of the frontally arranged outer faces of the web plates. The superimposed wall components engage in one another with the tongue and groove connection of their wall panels and are also interconnected in the indicated manner. The worker erecting the wall consequently is able to erect in a relatively short time a hollow building wall having a considerable stability using easily assemblable wall components, which e.g. have a length of approximately 1 meter, a height of approximately 40 cm and a depth corresponding to the desired wall thickness, so that they are easy to handle.

The interior of the wall formed between the wall panels can be filled with an insulating material, e.g. cellulose, wood shavings, cork scraps, straw, pugging mortar or glass wool, so that a good thermal and/or sound insulation can be obtained.

On the building site a support structure in the form of a three-dimensional frame is installed for the building and has vertical supports, horizontal beams and ground beams. The ground beams run on the cellar ceiling or foundation plate with the desired orientation of the wall. On the ground beams can be mounted the wall components, which form the lower layer of the wall. In order to ensure an adequately stable fitting of the wall components of the lower layer on the associated ground beam, according to a preferred development of the invention, the wall panels of the lower layer of the wall components receive between them the ground beam of the building support structure and are connected thereto. This can be brought about in that the underside of the web plates are at a given spacing above the underside of the wall panels, so that the web plates do not impede the engaging round of the ground beam.

The vertical supports of the building support structure must be located within the wall construction. Therefore the wall panels receive a support of the building support structure between them and are connected thereto. This can be achieved in that at least one web plate of the wall component is inwardly displaced towards its centre, so that the wall panels freely project on one side of the wall component and can in this way again engage around the pre-assembled support, without this being impeded by the web plate. It is also possible to use for the reception of a support a wall component, whose wall panels comprise panel elements interconnected by means of detachable fittings.

Such a two,part wall component is assembled by means of the fittings, after introducing the support between the freely projecting panel elements. If the connected panel elements are in one plane, a wall component having a parallel-epipedic design is formed. However, if the panel elements are under an angle of e.g. 90° when assembled, then a wall component is created for a right-angled building corner, in which can be received a corner support of the frame structure.

In order to fore a corner in a wall without simultaneously having to receive a support, according to a preferred development of the invention between two wall components is provided an angle piece, which is engaged with the wall components by means of connecting elements. The angle piece is preferably made from wood and has a roughly rhomboid cross-section, whose longitudinal sides are in each case connected to the end faces of the adjacent wall components, e.g. by means of a tongue and groove connection. Thus, the wall components are at an angle to one another, whose size is a function of the angle piece design.

These and further details and features of the invention can be gathered from the following non-limitative description of an embodiment with reference to the attached drawings, wherein show:

BRIEF DESCRIPTION OF THE DRAWINGS

As shown in FIGS. 1 and 2, a wall component 10 has two vertical, parallel, planar wall panels 11 and 12 made from wood or a wooden material. The lateral ends of the wall panels 11 and 12 are kept spaced by means of web plates 13 and 14, also made from wood or a wooden material, running perpendicular to the panels 11 and 12. The wall panels and web plates are glued together and keyed by means of keys 17. The outside of the web plates 13, 14 passes flush into the end faces of the wall panels 11, 12. This leads to the formation of a box with a rectangular cross-section, which is open on the top and bottom and bounds an inner space 20.

As shown in FIG. 1, the tops of the web plates terminate flush with the tops of the wall panels. The bottoms of the web plates are at a specific distance above the bottoms of the wall panels. Both on the top and bottom of the wall panels 11, 12 and on their end faces are provided connecting elements in the form of a groove 16 and a tongue 15, which are used for engaging with corresponding connecting elements of adjacent wall components.

Figure 1:
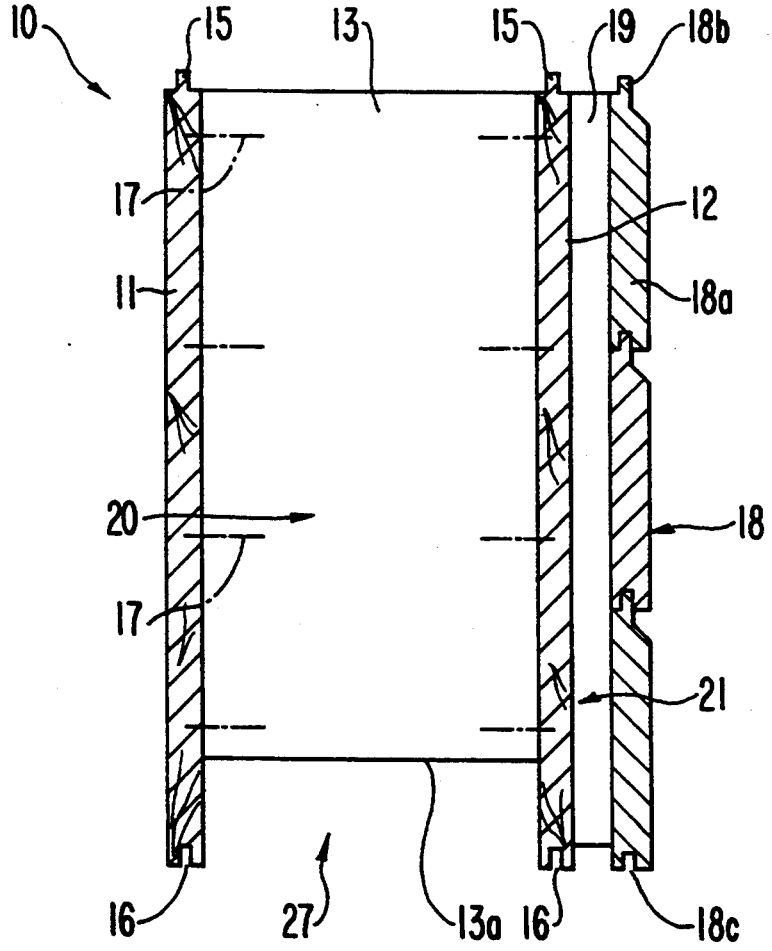
FIG. 1 shows a vertical section through a wall component according to a first embodiment of the invention.
Figure 2:
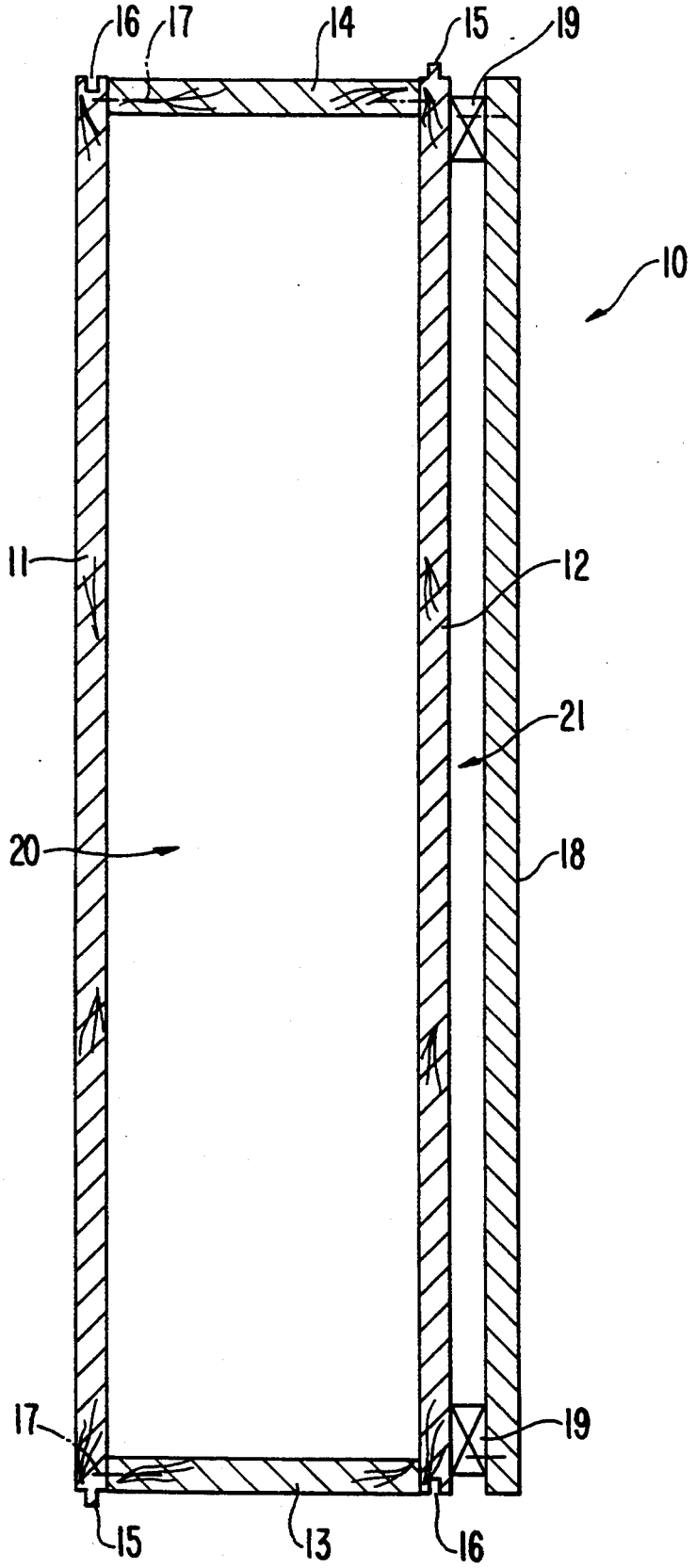
FIG. 2 shows a cross-section through the wall component of FIG. 1.

In the embodiment shown in FIG. 1 there is a tongue 15 on the top of each of the wall panels 11, 12 and there are correspondingly shaped grooves 16 on the bottoms. Each wall panel 11, 12 has, according to FIG. 2, on its one end face a groove 16 and on its opposite end face a tongue 15, the wall panels being reciprocally oriented in such a way that on each side of the wall component 10 there is a groove 16 and a tongue 15. To the outside of the outer wall panel 12 are fitted two perpendicularly directed, preferably wooden laths 19, which carry a support structure for a profile boarding 18 serving as a facing and which is also made from wood and which can be nailed or in some other way fixed to the laths 19. The profile boarding 18 comprises profile laths **18*a*, which on their top are provided with a tongue 18*b* and on their bottom with a groove 18*c*. The tongue 18*b* of a profile lath 18*a* engages in the groove 18*c* of the profile lath 18*a*** positioned above it and is fixed therein, so that the profile laths are reciprocally fixed.

The tongue **18*b* of the upper profile lath 18*a* of a wall component 10 can be engaged and fixed in the groove 18*c* of the lower profile lath 18*a* of a wall component 10 positioned above it, so that a union of the profile boarding 18 engaging over the individual wall components is obtained. As a result of the laths 19 the profile boarding 18 is kept spaced from the outer wall panel 12, so that a gap 21** serving for back-ventilation purposes is formed.

For the formation of a wall the wall components 10 are superimposed in a number of layers and interconnected- For the connection of juxtaposed wall components 10 of a layer the grooves 16 and tongues 15 formed on facing end faces are engaged. The facing outer faces of the web plates 15 of adjacent wall components are engaged on one another in such a way that the web plates 14 can be screwed together. Alternatively or additionally it is possible to glue the wall components 10 together, at least on the web plates 14. There is a butt-jointing of the profile boardings 18 of adjacent wall components.

The inner space of the wall component 10 can be filled with an insulating material 26, e.g. cellulose, wood shavings, cork scraps, glass wool or straw (FIG. 3) and then the next layer of wall components 10 is placed thereon. The wall components 10 of the next layer comes into engagement with their grooves 16 formed on the bottom of the wall panels 11 and 12 with the tongues 15 formed on the top of the wall panels of the underlying wall component and are also glue. Simultaneously the lower profile lath 18*a* of the upper wall component 10 comes into engagement in the described manner with the upper profile lath 18*a* of the underlying wall component. As the bottom 13*a* of the web plates 13 is spaced above the bottom of the wall panels 11, 12, when the wall components are mounted on one another a through passage 27 running in the longitudinal direction of the wall is formed and can receive the different installation lines.

Hereinafter the bottom connection of the-wall to an existing support structure is described.

Figure 3:
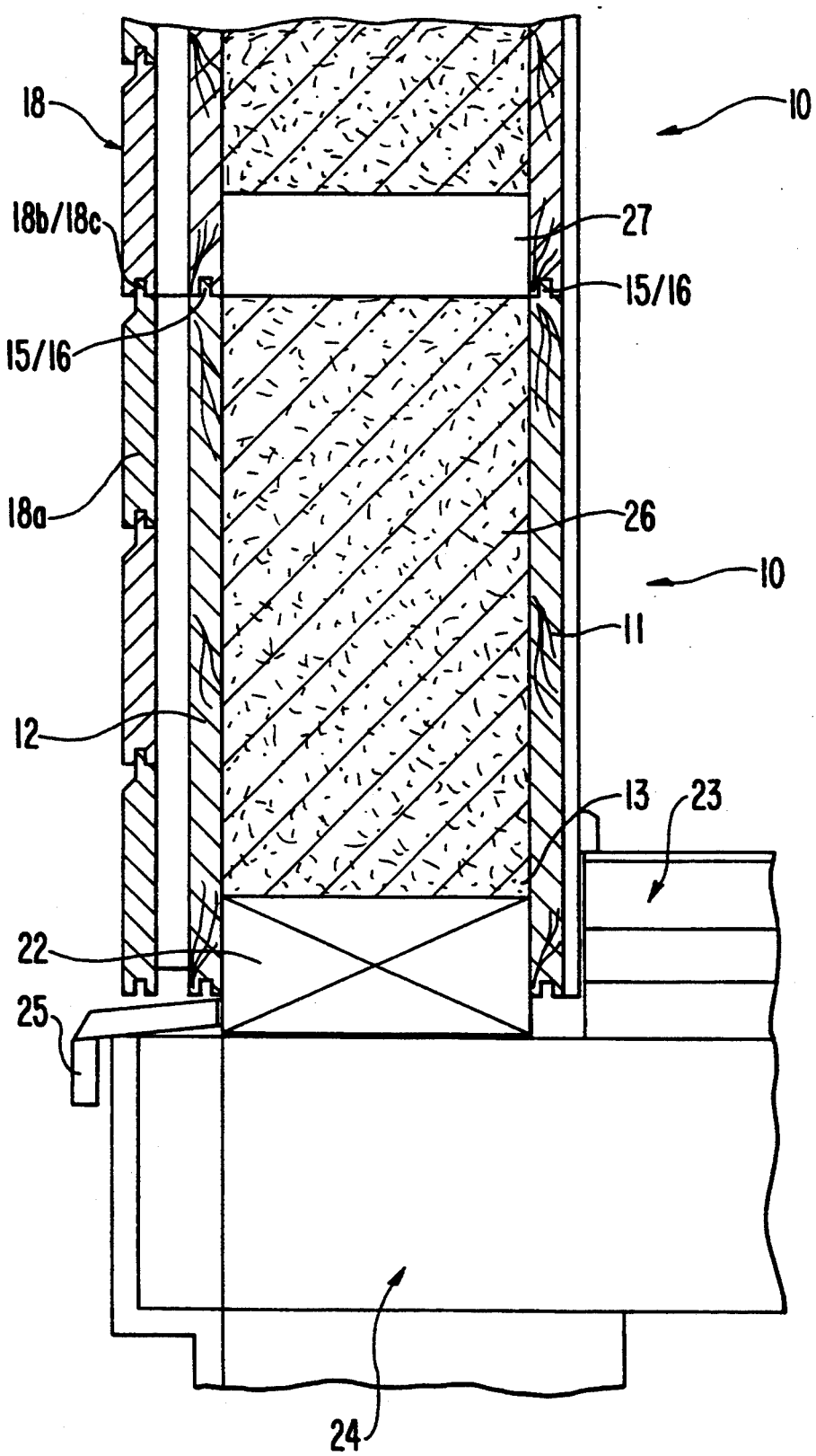
FIG. 3 shows a vertical section showing the lower connection of a wall.

According to FIG. 3 a cellar ceiling or foundation plate 24 is formed on which is arranged and fixed a ground beam 22. The width of the ground beam 22 corresponds to the spacing of the wall panels 11, 12, i.e. the internal width of the wall component. The bottom of the wall component 10 is placed on the ground bean 22, the wall panels 11 and 12 partly receiving between them the said ground beam 22. The wall component is completely positioned when the bottoms of the web plates 13, 14 engage with the top of the ground beam 22. In this position shown in FIG. 3 the wall component is fixed on the ground beam 22 by screwing and/or bonding or in some other way.

According to FIG. 3 it is also possible to see an externally positioned terminating profile 25, as well as a floor timbering 23 applied to the cellar ceiling or foundation plate 24.

Figure 4:
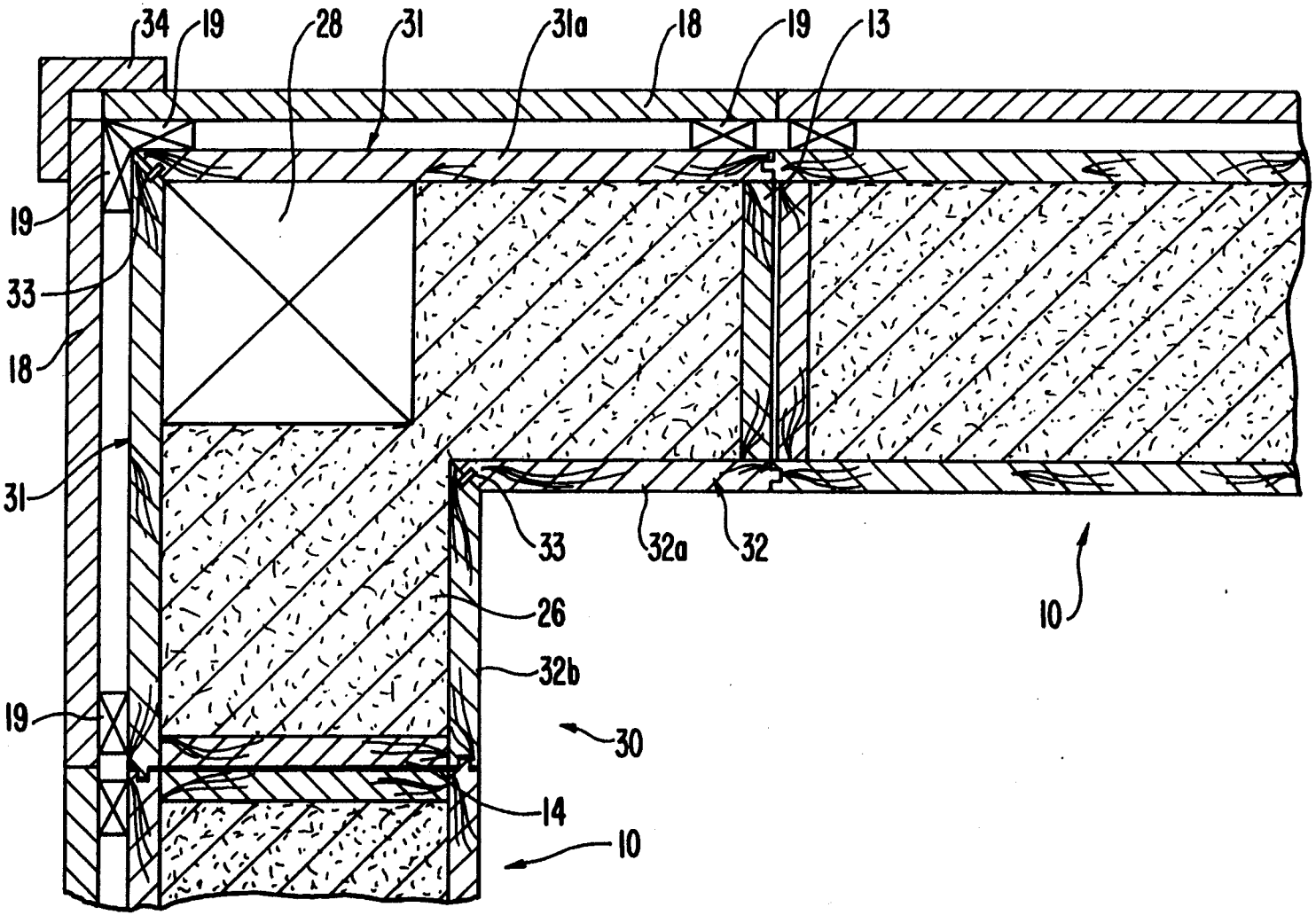
FIG. 4 shows a cross-section through a building corner.

FIG. 4 shows the construction of a building or wall corner or quoin. A vertical support 28 of the three-dimensional support frame has a square cross-section and is placed at the intersection of two substantially vertically directed walls, which in each case comprise the above-described wall components 10. As a connection for the two walls there is a wall component 30 in the form of a corner stone, which has two vertical, substantially parallel wall panels 31 and 32 made from wood, which are kept spaced in the described manner by means of the web plates 13, 14.

Each wall panel 31, 32 is built up from two vertical panel elements 31*a*, 31*b* or 32*a*, 32*b* to be applied to one another and which are detachably interconnectable by frontally applied fittings 33. In the assembled state the outer panel elements 31*a*, 31*b* and the inner panel elements 32*a*, 2*b* are perpendicular to one another, so that a right-angled corner is formed. The outer panel elements 31*a*, 31*b* are longer than the inner panel elements 32*a*, 32*b*. On the outside of the outer panel elements 31*a*, 31*b* is kept spaced a profile boarding 18 by means of vertical laths 19 and on the outer corner, where the profile boardings 18 converge, a cover fillet 34 is mounted from the outside.

The installation of the corner stone 30 will be described. When the panel elements 31*a*, , 31*b* on the one hand and 32*a*, 32*b* on the other are separated from one another, two stone parts are formed, which in each case have a web plate and a long, outer panel element 31*a*, or 31*b* projecting therefrom and a projecting, short panel element 32*a* or 32*b* running parallel thereto. One of these parts is placed on the support 28 in such a way that the inclined connection plane of the part coincides roughly with the diagonal of the support 28. On the other side of the support 28, which is displaced by 90°, is then correspondingly arranged the other part of the cornerstone, so that the free edges of the parts, on which the fittings 33 are located, can be fixed to one another. The corner stone is then appropriately fixed to the support 28 and the interior of the corner stone is filled with insulating material 26.

The connection of the corner stone to other corner stones above or below it takes place by means of a groove and tongue joint in the manner described hereinbefore. This also applies with regards to the connection of the corner stone to the wall components 10 of the adjacent walls.

Figure 5:
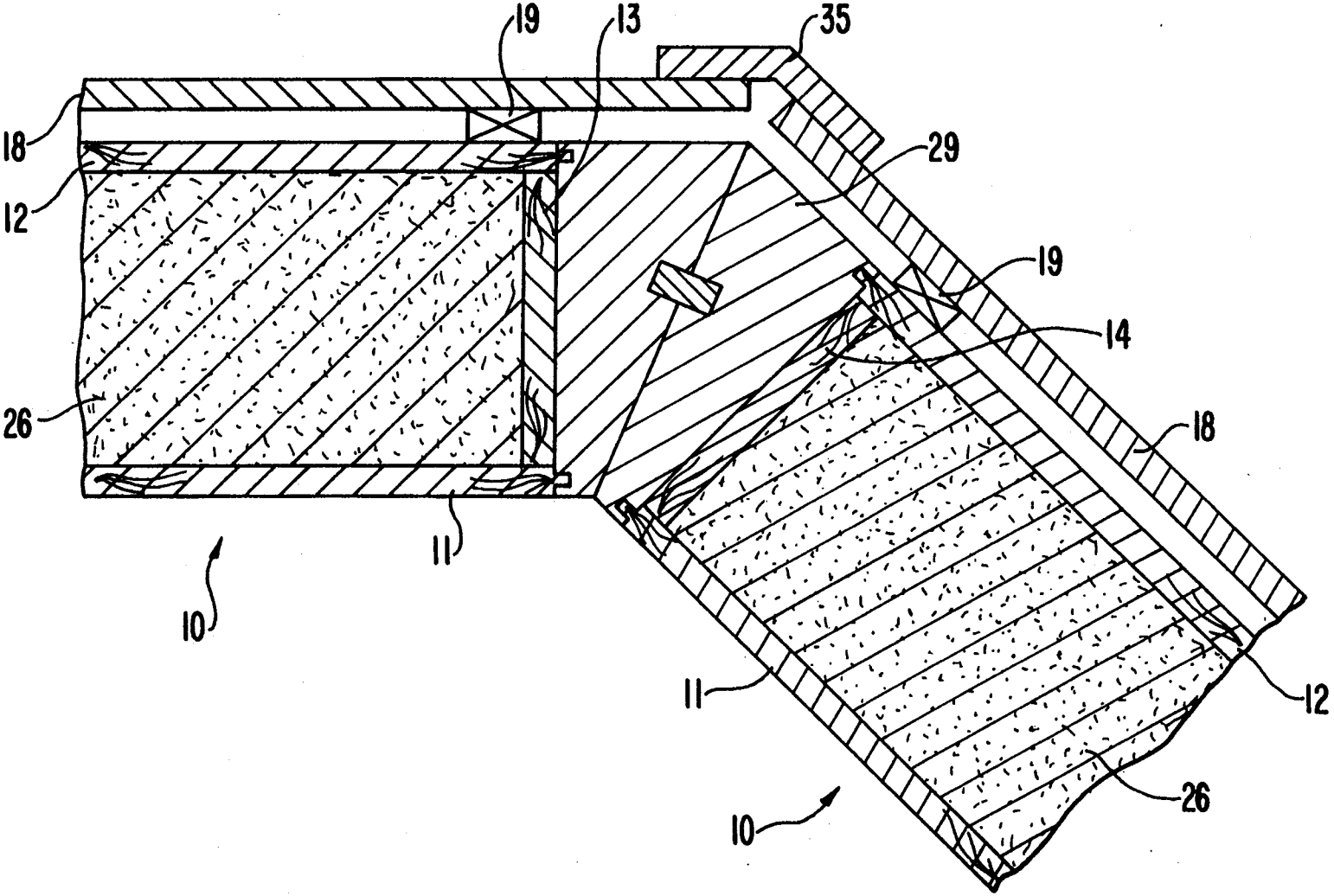
FIG. 5 shows a cross-section through a wall corner.

FIG. 5 shows a wall corner, in which two wall areas formed by wall components 10 meet at angle of approximately 135°. In the corner point there is an angle piece 29 acting as an adaptor, which has a substantially rhomboid cross-section, the outer, short rhombus edges being aligned with the outsides of the wall panels 12 of the wall components 10, whilst the long rhombus edges are in engagement by means of a spring and tongue connection with one end face of the adjacent wall component 10. The angle piece 29 is made from wood, preferably solid wood and can be constructed as a vertical adaptor support, so that only one angle piece 29 is required for several layers of wall components 10. However, it is also possible to have a separate angle piece for each layer.

The above-described profile boarding 18 of the wall component 10 is preferably extended in the vicinity of the corner over and beyond the wall component 10, so that the free ends of the profile boarding come to rest in the outer corner point of the angle piece 29. In order to cover the free edges of the profile boarding, from the outside is mounted a cover fillet 35.

FIG. 5 shows a so-called outer corner, the angle formed between the adjacent walls on the outside being larger than the angle on the inside. With a corresponding construction, it is also possible to form an inner corner and then the profile boarding would be fitted to the lower wall panels 11 according to FIG. 5.

Figure 6:
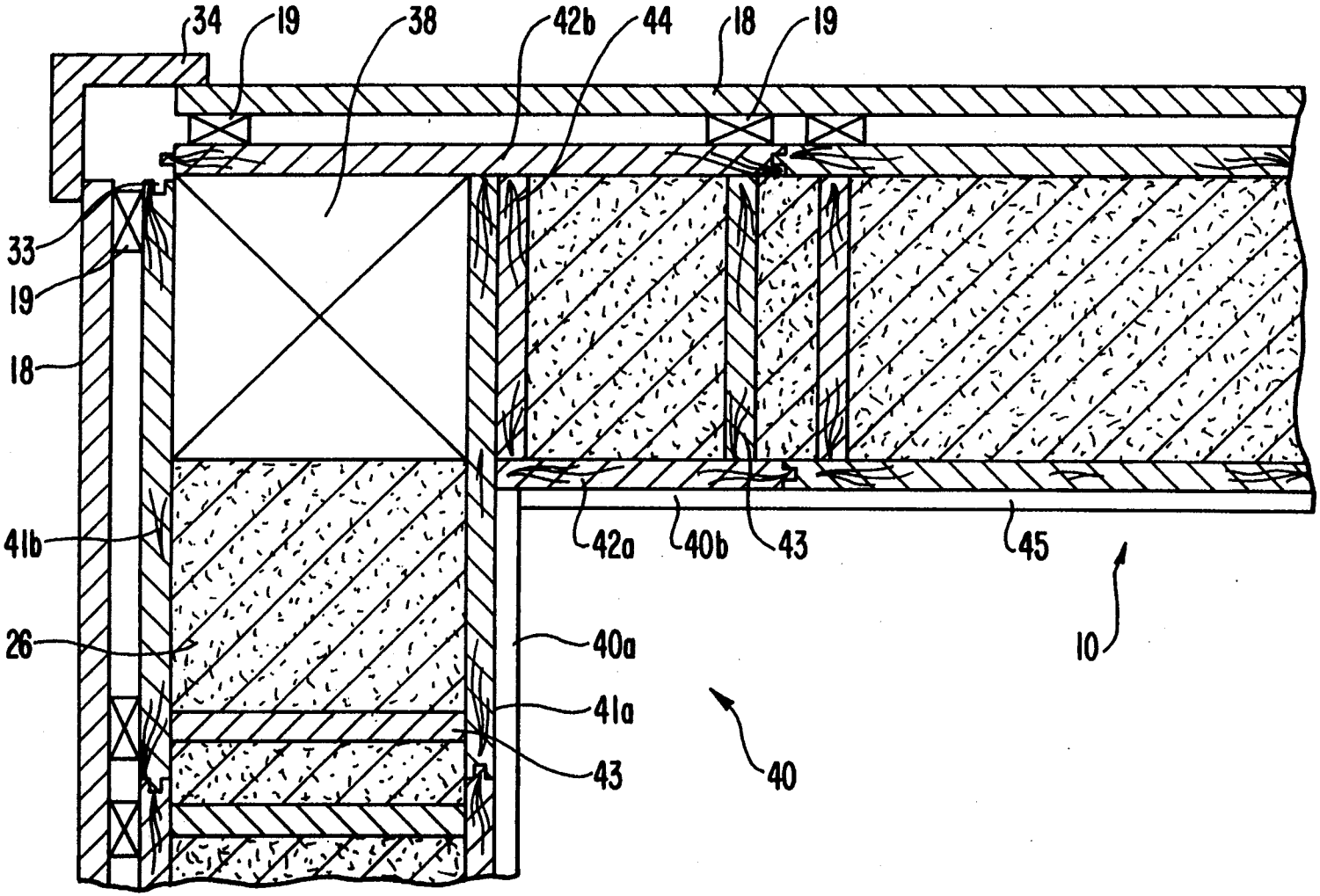
FIG. 6 shows an alternative embodiment for a building corner in cross-section.

FIG. 6 shows an alternative construction of a building or wall corner or quoin according to FIG. 4. A vertical support 38 of the three-dimensional support frame has a square cross-section and is located in the intersection of two substantially perpendicular walls, which in each case comprise the above-described wall components 10. As the connection for the two walls there is a wall component 40 in the form of a corner stone, which comprises two individual stones 40*a* and 40*b*. The corner stone 40*a* has two vertical, substantially parallel wooden wall panels 41*a*, 41*b*, which are kept spaced in the described manner by means of a web plate 43. The web plate 43 is spaced from the end faces of the wall panels 41*a*, 41*b*. At the opposite end the wall panels 41*a*, 41*b* are interconnected by means of a web plate, so that the vertical support 38 can be inserted between the panels 41, 41*b*. The inside of the wall panels 41*a*, 41*b* is located on the lateral faces of the vertical support 38.

The further individual stone 40*b* has two, vertical, parallel wall panels 42*a*, 42*b*, which are kept spaced by means of two web plates 43, 44. The outer wall panel 42*b* is roughly twice as long as the inner wall panel 42*a*, but the end faces of the wall panels 42*a*, 42*b* remote from the support 38 are located in one plane.

While the web plate 43 remote from the support 38 is spaced from the end faces of the wall panels 42*a*, 42*b*, the web plate 44 facing the support 38 terminates flush with the end face of the shorter, inner panel 42*a* and is connected to the outer panel 42*b* roughly in its central area.

On the outside of the outer wall panels 41*b* and 42*b* of the individual stones 40*a* and 40*b* is kept spaced by means of vertical laths 19 a profile boarding 18 and on the outer corner, where the profile boardings 18 converge, is mounted from the outside a cover fillet 34.

The installation of the corner stone 40 will now be described in greater detail. Firstly the first individual stone 40*a* is positioned relative to the vertical support 38 so that the latter is located between the wall panels 41*a*, 41*b*. The end faces of the wall panels 41*a* and 41*b* are flush with one lateral face of the vertical support 38. The further individual stone 40*b* is then positioned laterally on the vertical support 38 in such a way that the end face of the inner wall panel 42*a* and the web plate 44 terminating flush therewith come to rest on the outside of the wall panel 41*a* of the individual stone 40*a*. The outer, longer wall panel 42*b* of the individual stone 40*b* is engaged with the end faces of the wall panels 41*a* and 41*b* and the lateral face of the vertical support 38 terminating flush therewith. This state is shown in FIG. 6. The individual stones 40*a*, 40*b* are then appropriately fixed together and also to the support 38 and the inner space of the individual stones is filled with insulating material 26.

The connection of the corner stone 40 to corner stones positioned above and below it takes place by means of a groove and tongue joint in the above-described manner. This also applies with regards to the connection of the corner stone to the wall components 10 of the adjacent walls. As shown in FIG. 6, the wall formed from the wall components and the corner stones is provided on its inside with a wood covering or gypsum plasterboard 45. It can be a so-called Fermacell board. A corresponding board or covering can also be provided in the other embodiments.

I claim:

1. A wall component for forming a building wall comprising:

two vertical parallel wall panels made from wood or a wooden material and having top, bottom and end faces;

two vertical web plates made from wood or a wooden material, the vertical web plates being joined to the two vertical parallel wall panels and extending substantially perpendicular to the two vertical parallel wall panels and keeping the two vertical parallel wall panels spaced apart by a width of the two vertical web plates; and connecting elements disposed on the top, bottom and end faces of the two vertical parallel wall panels in the form of grooves and tongues for engaging corresponding connecting elements of neighboring wall components; and wherein an outer face of the two vertical web plates terminates flush with the end faces of the two vertical parallel wall panels; and a top of the two vertical web plates terminates flush with a top of each of the two vertical parallel wall panels.

2. A wall component according to claim 1 wherein:

a bottom of the two vertical web plates is spaced above the bottom of the two vertical parallel wall panels.

3. A wall component according to claim 1 wherein:

the two vertical parallel wall panels and the two vertical web plates are glued or bonded and/or clamped and/or screwed and/or nailed and/or keyed together.

4. A wall component according to claim 1 wherein:

an inner space of the wall component bounded by the two vertical parallel wall panels and two vertical web plates is filled with insulating material.

5. A wall component according to claim 1 wherein:

an outer one of the two vertical parallel wall panels has a facing spaced from an outside surface of the outer of the two vertical parallel wall panels.

6. A wall component according to claim 5 wherein:

the facing is spaced from the outer one of the two vertical parallel wall panels by means of a support structure.

7. A wall component according to claim 5 wherein:

the facing is formed from one of a profile boarding, plaster or clinker facing.

8. A wall component according to claim 1 wherein:

the two vertical parallel wall panels are substantially planar.

9. A wall component according to claim 1 wherein:

the two vertical parallel wall panels are angular.

10. A wall component according to claim 9 wherein:

the two vertical parallel wall panels comprise two interconnected panel elements.

11. A wall component according to claim 1 wherein:

the two vertical parallel wall panels are interconnected by means of detachable fittings.

12. A wall component according to claim 10 wherein:

the two vertical parallel wall panels are at a right angle to one another.

13. A wall formed from a plurality of wall components according to claim 1 wherein:

the wall components are superimposed and juxtaposed in several layers and interconnected.

14. A wall according to claim 13 wherein:

adjacent wall components of a layer are interconnected by means of frontally arranged outer faces of the two vertical web plates.

15. A wall according to claim 13 wherein:

the wall components are glued or bonded and/or clamped and/or screwed and/or nailed and/or keyed together.

16. A wall according to claim 13 wherein:

an inner space of the wall bounded by the two vertical parallel wall panels is filled with insulating material.

17. A wall according to claim 13 wherein:

the two vertical parallel wall panels of a lower layer of the wall components receive therebetween a ground beam of a building support structure and are connected thereto.

18. A wall according to claim 13 wherein:

the two vertical parallel wall panels receive between them a support of a building support structure and are connected thereto.

19. A wall according to claim 13 further comprising:

an angle piece engaging the wall components by means of connecting elements to form a corner between the two vertical parallel wall components.

* * * * *